United States Patent [19]

Theurer

[11] Patent Number: 4,854,243

[45] Date of Patent: Aug. 8, 1989

[54] MOBILE TRACK RENEWAL MACHINE

[75] Inventor: Josef Theurer, Vienna, Austria

[73] Assignee: Franz Plasser Bahnbaumaschinen-Industriegesellschaft m.b.H., Vienna, Austria

[21] Appl. No.: 54,182

[22] Filed: May 26, 1987

[30] Foreign Application Priority Data

Jul. 25, 1986 [EP] European Pat. Off. ..... 86 890 218.0

[51] Int. Cl.[4] ..... E01B 27/11

[52] U.S. Cl. ..... 104/7.3; 171/16; 104/9

[58] Field of Search ..... 104/9, 8, 7.3, 7.2, 104/7.1, 2, 17.2; 37/104, 106, 107; 171/16

[56] References Cited

U.S. PATENT DOCUMENTS

| | | | |
|---|---|---|---|
| 2,899,759 | 8/1959 | Campbell | 37/104 |
| 3,685,456 | 8/1972 | Plasser et al. | 104/2 |
| 3,872,929 | 3/1975 | Theurer et al. | 171/16 |
| 4,010,691 | 3/1977 | Theurer et al. | 104/7.3 |
| 4,152,989 | 5/1979 | Theurer et al. | 104/2 |
| 4,160,418 | 7/1979 | Theurer | 104/2 |
| 4,178,995 | 12/1979 | Theurer et al. | 171/16 |
| 4,211,170 | 7/1980 | Theurer | 104/2 |
| 4,263,851 | 4/1981 | Theurer et al. | 104/7.1 |
| 4,316,416 | 2/1982 | Theurer et al. | 104/7.1 X |

FOREIGN PATENT DOCUMENTS

| | | | |
|---|---|---|---|
| 3223350 | 1/1984 | Fed. Rep. of Germany . | |
| 982130 | 6/1951 | France . | |
| 1541038 | 2/1979 | United Kingdom . | |
| 2074218 | 10/1981 | United Kingdom | 104/7.3 |
| 2134574 | 8/1984 | United Kingdom . | |

OTHER PUBLICATIONS

Railway Gazette International, Feb. 1985, pp. 120/1.

*Primary Examiner*—Robert B. Reeves
*Assistant Examiner*—Gary C. Hoge
*Attorney, Agent, or Firm*—Kurt Kelman

[57] ABSTRACT

A mobile machine for continuously renewing a track by replacing the rails and ties of the existing track by new rails and ties has an elongated, two-part, bridge-like machine frame supported on the track by a front and a rear undercarriage. The facing ends of the machine frame parts are pivotally coupled together at lower ends thereof, and hydraulic pivoting and blocking drives interconnect these facing ends and are effective to spread the facing machine frame part ends apart at upper ends thereof in a horizontal direction whereby the lower ends of the facing machine frame part ends are raised in a vertical direction, and the raised facing machine frame part ends are blocked in their raised position. An intermediate undercarriage supports the facing machine frame part ends on the track and is raised off the track with the lower ends of the facing machine frame part ends. The machine frame carries devices for lifting and spreading the old rails off the ballast bed rails, for lifting the old ties off the ballast bed whereby residual mounts of ballast remain on the ballast bed between areas thereof where the lifted ties were embedded in the ballast bed, a ballast excavating and planing chain arranged to excavate the residual ballast mounds and to smooth the ballast bed, devices for laying the new ties on the smooth ballast bed and for spreading and laying the new rails on the new ties. A ballast conveyor is mounted on the rear machine frame part for receiving the excavated ballast from the chain.

16 Claims, 1 Drawing Sheet

MOBILE TRACK RENEWAL MACHINE

Figures 1, 2, 3, 4:
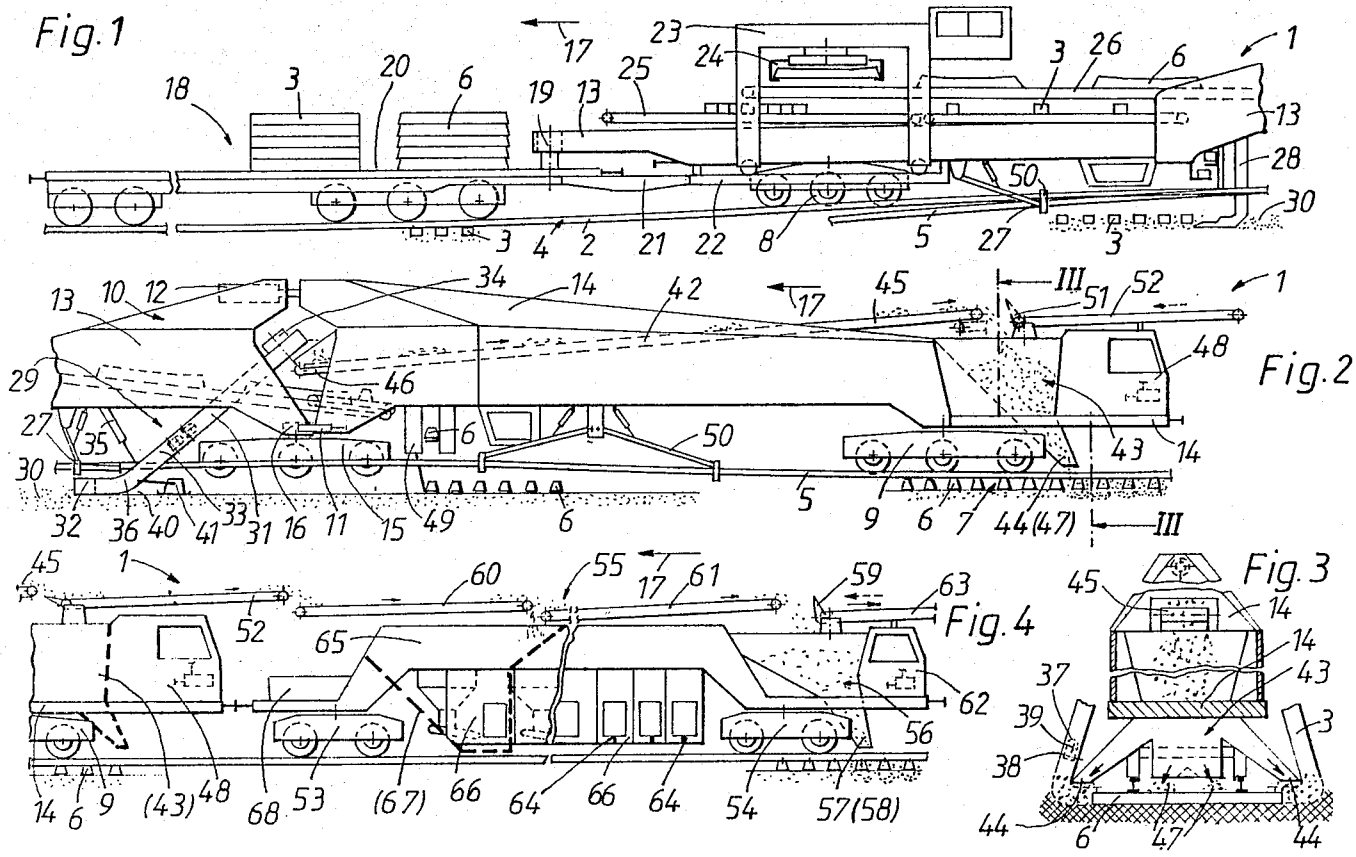

The present invention relates to a mobile machine comprising an elongated, bridge-like machine frame mounted on a track consisting of two rails fastened to successive ties supported on a ballast bed for mobility in an operating direction for continuously renewing the track by replacing the rails and ties of the existing track by new rails and ties. The machine frame comprises a front machine frame part having a front end and a rear end, a rear machine frame part having a front end and a rear end, the rear end of the front machine frame part and the front end of the rear machine frame part facing each other, a front undercarriage supporting the front end of the front machine frame part on the track, a rear undercarriage supporting the rear end of the rear machine frame part on the track, coupling means pivotally connecting the facing ends of the machine frame parts at lower ends thereof close to the ballast bed, hydraulic pivoting and blocking drive means interconnecting the facing ends of the machine frame parts and effective to spread the facing machine frame part ends apart at upper ends thereof remote from the ballast bed in a horizontal direction whereby the lower ends of the facing machine frame part ends are pivoted about the coupling means and raised in a vertical direction, and the raised facing machine frame part ends are blocked in their raised position, an intermediate undercarriage supporting the facing machine frame part ends on the track and being raised off the track when the lower ends of the facing machine frame part ends are pivoted about the coupling means and raised in a vertical direction, and means mounted on the elongated, bridge-like machine frame between the front and rear undercarriages for lifting the rails of the existing track off the ballast bed and spreading lifted rails apart, lifting the ties of the existing track off the ballast bed whereby residual mounds of ballast remain on the ballast bed between areas thereof where the lifted ties were embedded in the ballast bed, planing the ballast bed from which the ties have been lifted by removing the residual mounds of ballast, laying the new ties on the smooth ballast bed, and spreading and laying the new rails on the new ties.

U S. Pat. No. 3,685,456, dated Aug. 22, 1972, discloses a train assembly for the continuous replacement of an old track by a new track while simultaneously cleaning the ballast. A tri-partite work vehicle bridging a trackless renewal section comprises a center part supported by full-track undercarriages on the ballast bed and this center part is a ballast cleaning machine equipped with an endless ballast excavating chain succeeded by a ballast cleaning screen and a discharge conveyor for redistributing the cleaned ballast. A front part of the work vehicle is equipped with means for lifting the old ties off the ballast bed and for moving the lifted ties away, and a rear work vehicle part is equipped with means for laying the new ties and for moving them to the tie laying means. A succeeding work vehicle is equipped with means for fastening the new rails to the new ties and also carries a ballast storage bin leading to a discharge chute for redistributing the cleaned ballast in the cribs of the new track. A ballast conveyor band is arranged between the screen and the storage bin for conveying the cleaned ballast from the screen to the bin. While this machine for the continuous renewal of track has been commercially quite successful, it must be noted that the new track laid with this machine is not capable of supporting high-speed trains but must be properly lined and fixed in its accurate position with a track leveling, lining and tamping machine in a subsequent operation. Also, the train assembly comprises a great number of work vehicles and is, therefore, quite heavy and long. The full-track undercarriages running on the sub-grade after excavation of the ballast bed for cleaning tend to distort the established grade to an extent depending on the loads and the velocity of the vehicles. Therefore, the new ties are not always laid at the desired level and the inaccurate laying of the ties makes it sometimes difficult to fasten the new rails properly to the newly laid ties. Furthermore, the cleaned ballast is redistributed in a section of the newly laid track where the rails are not yet in full contact with the ties so that individual ballast pieces may interfere with an accurate laying of the ties and the rails as well as with the fastening of the rails to the ties.

British Pat. No. 2,134,574, published Apr. 9, 1986, discloses a ballast cleaning machine with an endless ballast excavating chain whose oblique guide troughs for the elongated stringers of the chain have bent end portions leading to and from the transverse chain stringer, which end positions extend substantially parallel to the ballast bed. The chain has links connected by universal joints, and guide elements are arranged in the bent end portions for longitudinally guiding the chain in its transition between the oblique and horizontal direction. Such a ballast excavating chain with a guidance of the chain parallel to the ballast bed serves to plane the ballast and results in an accurate leveling of the ballast bed surface.

U. S. Pat. No. 4,152,989, dated May 8, 1979, discloses a track renewal train comprised of several work vehicles for continuously removing old ties and laying new ties, with or without cleaning the ballast. A rear vehicle serving to bridge over the trackless renewal section has a bridge-like elongated frame carrying means for receiving the old ties and laying the new ties, the old and new ties being transported in the operating direction, as well as means for lifting and spreading the old rails and for spreading and laying the new rails. Furthermore, the frame carries an endless ballast excavating and planing chain in the range of a vertically adjustable auxiliary full-track undercarriage for planing the ballast bed and simultaneously remove to the track shoulder the mounts of ballast remaining on the bed after the old ties have been removed. A ballast cleaning screen is preferably associated with the ballast excavating chain. The excavated and preferably cleaned ballast is redistributed through chutes. The full-track undercarriage immediately behind the transverse excavating stringer of the chain which planes the ballast bed tends to disturb the planed surface so that the new ties are not always laid accurately at the desired level. Also, the ballast is redistributed immediately over the newly laid ties, which interferes with the subsequent laying of the new rails and has the same disadvantages as mentioned hereinabove.

Another mobile apparatus for the continuous replacement of an old track by a new track is disclosed in U. S. Pat. No. 4,211,170 dated July 8, 1980. The elongated, bridge-like machine frame constituting the main work vehicle of this apparatus is supported on the track by two undercarriages at the respective ends of the frame and is comprised of two frame parts whose facing ends are pivotally coupled together and connected by a hydraulic pivoting and blocking drive means effective in a vertical and horizontal direction. An intermediate undercarriage, which may be raised when the two machine frame parts are spread apart, supports the two facing machine frame part ends on the track during transit, and a ballast planing plow is arranged on the machine frame ahead of the intermediate undercarriage. In addition, the machine frame carries means for lifting the old rails and spreading the old rails, lifting the old ties off the ballast bed, laying the new ties on the planed ballast bed, and spreading and laying the new rails on the new ties. This apparatus for the first time provided a compact and relatively short track renewal machine, and the ballast planing plow produced a ballast bed level on which the new ties could be accurately laid. However, the ballast plow deposited accumulations of excavated ballast on the track shoulders adjacent the ends of the newly laid ties, which differed in quantity and position, depending on the prevailing ballast conditions. This, too, sometimes interfered with the accurate laying of the new ties and, furthermore, requires subsequent profiling of the ballast shoulders and/or removal of excess ballast. The ballast planing plow has the sole purpose of smoothing, compacting and profiling the ballast bed surface. A new track laid with this machine requires additional machines for completion before it can handle high-speed train traffic, such as ballast shoulder plows and/or ballast redistribution machines as well as machines equipped with rail fastening devices.

Finally, Railway Gazette International, February 1985, pp. 120/121, discloses an installation for rehabilitating the sub-grade of a ballast bed in conjunction with track leveling, lining and tamping by excavating the old ballast bed and laying down a sand layer upon which a new ballast bed is superposed. This installation uses the same type of two-part machine frame described hereinabove and carries an endless ballast excavating chain ahead of the intermediate undercarriage for removing the entire ballast of the bed and conveying it away from the excavating site. A surface compactor for compacting the soil of the sub-grade is mounted behind the transverse chain stringer which excavates the ballast. This main machine of the installation is followed by work vehicles for laying a gravel-sand mixture layer on the compacted sub-grade, for placing a new ballast bed on the gravel-sand layer, and for lining and/or leveling the track and tamping the new ballast under the ties of the lined and/or leveled track. This installation has been commercially quite successful but requires high-capacity conveyors for the gravel-sand mixture and for the ballast. No renewal of the ties and rails is involved in this track bed rehabilitation.

It is the primary object of this invention to provide a mobile machine of the first-indicated type for continuously renewing track by replacing the rails and ties of the existing track by new rails and ties, which provides a more accurate and faster replacement while retaining the compact and relatively short main work vehicle obtained by the known two-part machine frame, and which results in a substantially more stable and accurate positioning of the new track than heretofore obtainable.

The above and other objects are accomplished according to the invention in such a mobile machine with a ballast bed planing means constituted by a ballast excavating and planing chain arranged to excavate the residual ballast mounds and to smooth the ballast bed, and a ballast conveyor means mounted on the rear machine frame part, the ballast conveyor means having an input end facing the ballast excavating and planing chain for receiving the excavated ballast therefrom.

This machine is not only compact and relatively short but has the added advantage of providing high accuracy in laying the new track since the ballast excavating and planing chain will excavate only the residual ballast mounds remaining on the ballast bed between areas thereof where the lifted old ties were embedded in the ballast bed to smooth the ballast bed and, in the same operating stage, will convey the excavated ballast rearwardly in a direction opposite to the operating direction of the continuously advancing machine to redistribute this ballast at the newly laid track. The ballast is redistributed behind the rear undercarriage and no intervening full-track vehicles engage the planed ballast bed to disturb its level. Therefore, the new track is laid more accurately in a fast and highly economical manner. The machine has the further advantage that the load of the rear undercarriage and the frame part supported thereby is applied to the newly laid ties and rails, which automatically provides a surface compaction of the ballast bed before the excavated ballast is redistributed. No unwanted ballast pieces can become lodged under the new ties or between the new ties and new rails, which has had deleterious effects in previously known track renewal operations. The rearwardly conveyed excavated ballast may be redistributed immediately behind the rear undercarriage or all or part of it may be conveyed further back, for example for redistribution at more remote points or to freight cars following the machine. Any work vehicles coupled to the machine and running on the new track before excavated ballast is redistributed to the ballast bed will tend further to compact the ballast bed because of the load their undercarriages apply thereto.

The above and other objects, advantages and features of the present invention will become more apparent from the following detailed description of certain now preferred embodiments thereof, taken in conjunction with the somewhat schematic drawing wherein FIGS. 1 and 2 are side elevational views respectively showing a front portion of a mobile machine according to this invention, including means for lifting the rails of the existing track off the ballast bed and spreading the lifted rails apart, and for lifting the ties of the existing track off the ballast, and a rear machine portion including means for planing the ballast bed, laying the new ties on the smooth ballast bed and spreading and laying the new rails on the new ties, as well as ballast conveyor means and a ballast redistributing device;

FIG. 3 is a transverse section along line III—III of FIG. 2 on an enlarged scale, showing the ballast conveyor means and redistributing device; and FIG. 4 shows an embodiment wherein the machine of FIGS. 1 to 3 is followed by a work vehicle equipped with means for fastening the new rails to the new ties succeeded by a ballast redistributing device and/or, as indicated diagrammatically within broken lines, preceded by such a device.

Referring now to the drawing and first to FIGS. 1 to 3, there is shown mobile machine 1 comprising elongated, bridge-like machine frame 10 mounted on existing track 4 consisting of two rails 2 fastened to successive ties 3 and new track 7 consisting of new rails 5 and new ties 6 supported on a ballast bed for mobility in an operating direction indicated by arrow 17 for continuously renewing the track by replacing rails 2 and wooden ties 3 by rails 5 and concrete ties 6. The machine frame comprises front machine frame part 13 having a front end and a rear end, and rear machine frame part 14 having a front end and a rear end. The rear end of front machine frame part 13 and the front end of rear machine frame part 14 face each other, as shown at the left in FIG. 2. Front undercarriage 8 supports the front end of front machine frame part 13 on existing track 4 and rear undercarriage 9 supports the rear end of rear machine frame part 14 on new track 7. Coupling means 16 pivotally connects the facing ends of the machine frame parts at lower ends thereof close to the ballast bed. Hydraulic pivoting and blocking drive means 11 and 12 interconnect the facing ends of the machine frame part and are effective to spread the facing machine frame part ends apart at upper ends thereof remote from the ballast bed in a horizontal direction (see FIG. 2) whereby the lower ends of the facing machine frame part ends are pivoted about coupling means 16 and are raised in a vertical direction, and the raised facing machine frame part ends are blocked in their raised position. The pivoting and blocking is accomplished by supplying suitable amounts of hydraulic fluid to the hydraulic jacks used as drive means in the illustrated embodiment to move the jack pistons in the desired direction and blocking them in position. Intermediate undercarriage 15 supports the facing machine frame part ends on the track during transit of the machine and is raised off the track (see FIG. 2) when the lower ends of the facing machine frame part ends are pivoted about the coupling means and raised in a vertical direction in a trackless track renewal section.

As shown in FIG. 1, transport vehicle 18 precedes elongated, bridge-like machine frame 10. The transport vehicle has a flat bed 20 and the front end of front machine frame part 13 is pivotally supported by pivot 19 on flat bed 20 of transport vehicle 18. At the renewal site, front undercarriage 8 supporting the front end is raised by hydraulic pivoting and blocking drive means 11, 12 upon spreading the facing machine frame part ends apart in the horizontal position. Bridge 21 connects flat bed 20 of the transport vehicle with front machine frame part 13. Track 22 a portion of which is arranged on bridge 21 supports mobile gantry crane 23 for movement there along and has tie gripping, hoisting and turning device 24 for transporting the ties. Conveyor 25 for removing old ties 3 and superposed conveyor 26 for delivering new ties 6 are mounted on front machine frame part 13 and the conveyors run under hoisting device 24 for respectively lifting the old ties from conveyor 25 and placing the new ties on conveyor 26, the gantry crane moving the ties between transport vehicle 18 and the conveyors.

This arrangement advantageously lengthens the track section in which the rails are lifted and spread so that even very heavy rails are not unduly flexed while they are lifted and lowered sufficiently to enable the rail replacement to be effected. On the other hand, the arrangement improves the spacing between the various track replacement means in this track section defined between the rearmost undercarriage of the machine and the rear undercarriage of the transport vehicle, to assure a trouble-free operating coordination of these means. The gantry crane arrangement provides an effective transport of the old and new ties while the pivotal mounting of the front end of the front machine frame part on the transport vehicle enables the entire front machine frame part to be raised at the operating site for advantageous operation of the replacement means carried thereon.

Elongated, bridge-like machine frame 10 carries between undercarriages 8 and 9 means 27 for lifting rails 2 of existing track 4 off the ballast bed and spreading the lifted rails apart, means 28 for lifting the ties of the existing track off the ballast bed whereby residual mounds 30 of ballast remain on the ballast bed between the areas thereof where lifted ties 3 were embedded in the ballast bed, conveyor 25 receiving lifted ties 3 from lifting means 28, means 29 for planing the ballast bed from which the ties have been lifted by removing residual mounds 30 of ballast, means 49 receiving new ties 6 from conveyor 26 and for laying the new ties on the smooth ballast bed, and means 50 for spreading and laying new rails 5 on the new ties. Each of these means may be conventional.

According to the invention, ballast bed planing means 29 is constituted by generally conventional ballast excavating and planing chain 31 arranged to excavate residual ballast mounds 30 and to smooth the ballast bed. The illustrated ballast excavating and planing chain is an endless chain having transversely extending stringer 32 for excavating the ballast and two obliquely upwardly extending elongated stringers 33 guided in elongated troughs, and is arranged in front of intermediate undercarriage 15. Drive 34 moves the chain in an endless path and hydraulic drive 35 links the elongated guide troughs to front machine frame part 13 for vertically and laterally adjusting transversely extending stringer 32 of the chain with respect to the ballast bed. The length of the transversely extending stringer extends over the entire width of the ballast bed. As in the excavating chain of the British patent cited hereinabove, the elongated guide troughs have bent portions 36 leading to transversely extending stringer 32 of the chain and extending substantially parallel to the ballast bed. As shown in broken lines in FIG. 3, links 37 of endless excavating and planing chain 31 are connected by universal joints so that they may pivot or rotate in relation to each other about mutually perpendicular axes 38 and 39 for ready transition between the oblique elongated guide troughs, transition portions 36 and the transversely extending stringer, guide elements being arranged in bent portions 36 for guiding the chain as it changes direction. Such a ballast excavating chain makes it possible to obtain an accurately leveled, high-quality ballast surface 40. This effect is further enhanced by arranging vertically adjustable, transversely extending ballast planing and compacting device 41 adjacent transversely extending stringer 32 of the chain. The ballast planing and compacting device has substantially the same length as the transversely extending chain stringer and is preferably linked thereto. This arrangement produces not only an accurately leveled, smooth ballast surface but provides compaction of the ballast bed so as to provide a solid support for laying the new ties on the accurately leveled and smooth ballast surface.

As shown in FIG. 2, ballast conveyor means 42 is mounted on rear machine frame part 14 and has an input end facing ballast excavating and planing chain 31 for receiving the excavated ballast therefrom. The machine further comprises ballast redistributing device 43 mounted on elongated, bridge-like machine frame 10 and ballast conveyor means 42 has an output end for delivering the excavated ballast to the ballast redistributing device. As shown in FIGS. 2 and 3, ballast redistributing device 43 has adjustable ballast discharge openings 44 behind rear undercarriage 9 and arranged to discharge ballast at the respective ends of new ties 6. This arrangement of the ballast discharge openings enables the ballast to be redistributed adjacent the ends of the new ties in an area where chain 31 has excavated ballast so that the machine automatically produces a sufficient amount of ballast at the ends of the new ties to enable the subsequent tie tamping operation to proceed effectively.

Illustrated ballast conveyor means 42 is comprised of endless conveyor band 45 extending from intermediate undercarriage 15 to rear undercarriage 9 along the entire length of rear machine frame part 14. Input end 46 of the endless conveyor band is arranged immediately adjacent and under an upper end of ballast excavating and planing chain 31 for receiving the excavated ballast therefrom, and the endless conveyor band output end is arranged above ballast redistributing device 43 for delivering the excavated ballast thereto. This arrangement provides a very simple ballast conveyance bridge from the ballast excavating chain to the ballast redistributing device atop the rear machine frame part and enhances the very rational use of space for all operating equipment on the machine frame. Ballast redistributing device 43 is mounted on rear machine frame part 14 above rear undercarriage 9 and operator's cab 48 is mounted on the rear end of the rear machine frame part immediately behind the ballast redistributing device. This location of the operator's cab enables the operator to view the ballast redistribution and the quality of planed ballast surface 40 so that he may suitably control the ballast planing and redistributing operation by repositioning the transverse excavating chain stringer, if required, and/or by adjusting ballast redistributing discharge openings 44.

As shown in FIG. 3, ballast redistributing device 43 has additional ballast discharge openings 47 behind rear undercarriage 9, which are arranged to discharge ballast intermediate the respective new tie ends, and the ballast redistributing device further comprises a ballast storage bin with which ballast discharge openings 44 and 47 are in communication. Short transversely extending endless conveyor bands may be arranged at discharge openings 44 for transversely distributing the discharged ballast over the excavated areas laterally adjacent the new tie ends. The provision of the ballast storage bin enables the redistribution of the excavated ballast to be suitably adapted to varying ballast conditions and, in conjunction with adjustments of the discharge openings, to meter the redistributed ballast on the planed ballast bed in exact accordance with prevailing requirements. The location of the ballast discharge openings is preferably such that no excavated ballast will be redistributed in those areas where the new rails are subsequently fastened to the new ties but sufficient ballast will be provided in those areas where the new ties are subsequently tamped.

As shown in broken lines in FIG. 2, a turntable is positioned on rear machine frame part 14 between the discharge end of conveyor 26, on which new ties 6 are conveyed in the direction of their elongation, and means 49 for laying the new ties in a position extending transversely on smooth ballast surface 40, the turntable turning the new ties 90° for this purpose. Means 27 and 50, which are substantially identical, respectively lift and lower old rails 2 and new rails 5 after the rail fasteners have been removed and before they have been attached, the rails being spread apart for guidance alongside the machine between undercarriages 8 and 9. Ballast excavating and planing chain 31 operates within the working area in which the rails are spread apart, and is brought into its operating position by hydraulic adjustment drive 35.

The illustrated machine comprises additional endless ballast conveyor band 52 having an input end above ballast redistributing device 43 and projecting rearwardly beyond operator's cab 48. Selectively operable ballast flow deflecting element 51 between the output end of ballast conveyor means 42 and the input end of additional endless conveyor band 52 selectively directs the ballast to the redistributing device (in the illustrated position of element 51) or to the additional endless ballast conveyor band (in a non-illustrated position wherein deflecting element 51 is pivoted towards the output end of ballast conveyor means 42 to bridge the gap between this output end and the input end of conveyor band 52). The provision of the additional endless ballast conveyor band has the advantage that any excess ballast not needed for redistribution to the ballast bed may be removed. If this conveyor band can be driven in opposite directions, it may also be used to deliver additional ballast to the ballast redistributing device if more ballast is needed for redistribution than is received from the ballast excavating and planing chain. Additional endless conveyor band 52 is pivotal laterally to throw the removed ballast on the track shoulder or into a box car stationed on an adjacent track and may be displaceable longitudinally with respect to the track, for example by being telescopically retractable in the direction indicated by a short arrow shown in broken lines. In this manner, endless ballast conveyor band 52 may be extended beyond operator's cab 48 into the position shown in full lines in FIG. 2 to convey the ballast to a succeeding box car or a track leveling, lining and tamping machine equipped with a ballast redistributing device and coupled to machine frame 10.

FIG. 4 illustrates an embodiment wherein work vehicle 55 succeeds, and is coupled to, elongated, bridge-like machine frame 10 which may or may not carry ballast redistributing device 43, as indicated by broken lines. The work vehicle has frame 65 supported by front undercarriage 53 and rear undercarriage 54 on new track 7. Means 64 for fastening new rails 5 to new ties 6 are mounted on the work vehicle between the undercarriages. Rail fastening means 64 are vertically and longitudinally adjustably mounted in a succession of pairs of cabs 66 suspended from work vehicle frame 65 adjacent the new rails. Ballast redistributing means 56 is mounted adjacent undercarriage 54 of the work vehicle and, as indicated by broken lines, another ballast redistributing means 67 may be optionally mounted adjacent undercarriage 53. Ballast redistributing means 56 is substantially identical with above-described ballast redistributing device 43 and has ballast discharge openings 57, 58 for redistributing ballast on the ballast bed laterally adjacent the opposite ends of the new ties and therebetween. Additional ballast conveyor means comprised of two successive endless conveyor bands 60, 61 is mounted atop work vehicle frame 65 for conveying ballast to the ballast redistributing means. Endless conveyor bands 45, 60 and 61 constitute a continuous conveyance path for the excavated ballast from the ballast excavating and planing chain to the ballast redistributing means. An additional endless ballast conveyor band 63 has an input end above ballast redistributing device 56, and additional selectively operable ballast flow deflecting element 59 (similarly to ballast flow deflecting element 51) between additional endless ballast conveyor means 60, 61 and the input end of additional endless ballast conveyor band 63 selectively directs the ballast to ballast redistributing device 56 or the additional endless ballast conveyor band. This additional endless ballast conveyor band functions similarly to conveyor band 52, as described hereinabove, and is pivotal laterally and displaceable longitudinally with respect to the track. Also equivalently to the position of operator's cab 48 within view of ballast redistributing device 43, operator's cab 62 is mounted at the rear end of work vehicle 55 within view of ballast redistributing device 56, and endless ballast conveyor band 63 projects rearwardly beyond the operator's cab. Only one ballast redistributing device equipped with a ballast storage bin will be used in the operation of the machine so that, when device 56 is in use, device 43 will be omitted. This may be done either by placing ballast flow deflecting element 51 into the position shown at the left in FIG. 4, i.e. to direct the ballast flow from conveyor means 45 to endless conveyor band 52, or by providing no ballast redistributing device on machine frame 10 and extending endless ballast conveyor band 45 to bridge the gap between rear undercarriage 9 of machine frame 10 and front undercarriage 53 of work vehicle 55 whereby the excavated ballast is delivered directly to endless ballast conveyor band 60.

With this embodiment of the machine, it is possible not only to replace the ties and rails continuously as the machine advances in the operating direction indicated by arrow 17 but also to fasten the new rails to the new ties in a single operating stage in a very economical manner while assuring a very accurate positioning of the new track. In addition to this advantage, sufficient ballast will be redistributed between the new ties and also at their opposite ends to enable a subsequent tie tamping operation to be effected so that the ties are securely held in their desired position by tamping the ballast under the ties and against the tie ends. At the same time, the work vehicle provides room for suspended operator's cabs holding operators for fastening the new rails to the new ties in the same operating stage, conveyors being provided to convey the necessary fastening elements to the respective cabs. This further enhances the efficiency of the machine. Additional endless ballast conveyor band 63 serves the same purpose as conveyor band 52, i.e. excess ballast may thereby be removed from the machine or additional ballast may be delivered thereto, depending on prevailing ballast conditions.

As shown in heavy broken lines in FIG. 4, it is also possible to replace ballast redistributing device 43 and/or 56 by a like ballast redistributing device 67 with a storage bin, which is mounted on work vehicle frame 65 immediately behind front undercarriage 53 and ahead of rail fastening means 64. Ballast redistributing device 67 also has suitable ballast discharge openings for redistributing the excavated ballast in a desired pattern. The output end of endless ballast conveyor band 60 is arranged above device 67 for delivering the excavated ballast thereto. This arrangement is particularly advantageous in a track renewal operation producing a considerable amount of excavated ballast.

Work vehicle 55 has its own drive 68 so that it may also be used independently as a self-propelled work vehicle in different track renewal operations.

The operation of mobile machine 1 will partly be evident from the above description of its structure and will now be described in detail.

While the machine advances continuously in the operating direction indicated by arrow 17, old rails 2, which have previously been detached from old ties 3, are gradually lifted off the old ties and spread apart. Means 28 is then operated to lift old ties 3 off the ballast bed where they are embedded and to move the ties to conveyor 25 which conveys them forwardly within the range of gantry crane 23 running on track 22 mounted on front machine frame part 13. Hoisting device 24 grips the old ties and the gantry crane places the old ties on suitable pallets. During the entire track renewal operation, the front end of front part 13 of machine frame 10 is supported by pivot 19 on flat bed 20 of transport vehicle 18. At the same time, front and rear machine frame parts 13, 14 are spread apart in a horizontal direction parallel to the track by extending jack 12 of the hydraulic pivoting and blocking drive means and may also be spread apart in a horizontal direction transversely to the track by operation of jack 11 of the hydraulic pivoting and blocking drive means, for example in track curves. This pivoting and concomitant spreading of the two machine frame parts causes the entire front machine frame part to be pivoted about pivot 19 whereby front undercarriage 8 as well as intermediate undercarriage 15 are raised. Old rails 2 and new rails 5 are sufficiently spread apart by rail lifting and spreading means 27 and 50 that old ties 3 and new ties 6 may be lifted and lowered between the spread rails by means 28 and 49, respectively, in their transverse position. Residual ballast mounds 30 between areas of the ballast bed where the lifted old ties were embedded are excavated by ballast excavating and planing chain 31 to obtain smooth ballast surface 40 and the excavated ballast is thrown onto endless ballast conveyor band 45. Meanwhile, the new ties 6, which have been turned 90° by hoisting device 24 to be placed on conveyor 26 in a position extending parallel to the track to enable them to be conveyed through endless ballast excavating and planing chain 31, are moved by conveyor 26 to a turning device which turns them 90° to be delivered to tie laying means 49 in a transverse position with respect to the track. The tie laying means places new ties 6 at desired distances on smooth ballast bed surface 40 which has been pre-compared by surface compactor 41. Suitably placed operator's cabs shown in the drawing enable operators to monitor all the operations visually and to control the operations.

The distance between spread new rails 5 is now reduced to the gage of the new track and the new rails are laid by means 50 on suitable support plates for the rails on newly laid ties 6 so that rear undercarriage 9 of machine frame 10 runs on new track 7. At this point, the new track is freely supported on the ballast bed and the excavated ballast is now redistributed through discharge openings 44 and 47 to embed the new track, the discharge openings being suitably adjusted according to prevailing ballast conditions. The discharged ballast falls into the cribs at each side of the rails and at the tie ends, the discharge openings being so arranged that no ballast will fall immediately adjacent the rails, which could interfere with the subsequent fastening of the rails to the ties. The ballast redistribution is controlled from operator's cab 48 whence the operator may visually monitor the ballast discharge for rapidly changing the amounts of ballast discharged, depending on local ballast conditions. If indicated, excess ballast may be removed by additional conveyor band 52 by operation of ballast flow deflecting element 51 or the additional conveyor band may be reversed to deliver additionally needed ballast to the storage bin of ballast redistributing device 43. Ballast surface 40 produced by excavating and planing chain 31 and surface compactor 41 is absolutely smooth along its entire length and width, has the desired level and is pre-compacted to provide an excellent support for new ties 6 so that the new track is laid accurately lined and leveled. The new rails are solidly supported on these ties so that the resultant new track provides a good support for undercarriage 9 and the machine can run on the new track at more or less normal speed.

The embodiment of FIG. 4 operates substantially in the same manner, except as hereinbelow described. While machine 1 continuously advances, the operators in successive cabs 66 lay various fastening elements, such as clamping plates, support plates, spikes, etc., on newly laid ties 6, which are conveyed to the respective cabs from respective storage bins for such fastening elements by short endless conveyor bands leading from the respective storage bins to the respective cabs, as schematically shown in FIG. 4. Fastening means 64 are then operated to fasten new rails 5 to new ties 6 to provide a completed new track on planed ballast surface 40. After or before the rails are fastened to the ties, the operator in cab 62 redistributes ballast conveyed by conveyors 45, 52, 60 and 61 to the new track by actuating the discharge openings of ballast redistributing device 56 or 67. Any excess ballast exceeding the capacity of the storage bin of the ballast redistributing device may be removed by endless conveyor band 63 by pivoting ballast flow deflecting device 59 in the transfer position being conveyor bands 61 and 63. If the ballast is redistributed by device 56 behind rear undercarriage 54, the operator need not be particularly concerned with leaving the areas along the rails free of ballast since the rails have already been fastened to the ties when the ballast is redistributed. The new track laid by machine 1 may be finished by an immediately following track leveling, lining and tamping machine.

What is claimed is:

1. A mobile machine comprising an elongated, bridge-like machine frame mounted on a track consisting of two rails fastened to successive ties supported on a ballast bed for mobility in an operating direction for continuously renewing the track by replacing the rails and ties of the existing track by new rails and ties, the machine frame comprising (a) a front machine frame part having a front end and a rear end, (b) a rear machine frame part having a front end and a rear end, the rear end of the front machine frame part and the front end of the rear machine frame part facing each other, (c) a front undercarriage supporting the front end of the front machine frame part on the track, (d) a rear undercarriage supporting the rear end of the rear machine frame part on the track, (e) coupling means pivotally connecting the facing ends of the machine frame parts at lower ends thereof close to the ballast bed, (f) hydraulic pivoting and clocking drive means interconnecting the facing ends of the machine frame parts an effective to spread the facing machine frame part ends apart at upper ends thereof remote from the ballast bed in a horizontal direction whereby the lower ends of the facing machine frame part ends are pivoted about the coupling means and raised in a vertical direction, and the raised facing machine frame part ends are blocked in their raised position, (g) an intermediate undercarriage supporting the facing machine frame part ends on the track and being raised off the track when the lower ends of the facing machine frame part ends are pivoted about the coupling means and raised in a vertical direction, (h) means mounted on the elongated, bridge-like machine frame between the front and rear undercarriages for (1) lifting the rails of the existing track off the ballast bed and spreading the lifted rails apart, (2) lifting the ties of the existing track off the ballast bed whereby residual mounds of ballast remain on the ballast bed between areas thereof where the lifted ties were embedded in the ballast bed, (3) planing the ballast bed from which the ties have been lifted by removing the residual mounds of ballast, the ballast bed planing means being constituted by a ballast excavating and planing chain arranged to excavated the residual ballast mounds and to smooth the ballast bed, (4) laying the new ties on the smooth ballast bed, and (5) spreading and laying the new rails on the new ties, (i) a ballast conveyor means mounted on the rear machine fame part, the ballast conveyor means having an input end facing the ballast excavating and planing chain for receiving the excavated ballast therefrom, and an output end for discharging the excavated ballast, and (k) a ballast redistributing device arranged behind the rear undercarriage for receiving the excavated ballast discharged from the output end of the ballast conveyor means and for redistributing the excavated ballast on the smooth ballast bed on which the new ties and new rails have been laid.

2. The mobile machine of claim 1, wherein the ballast excavating and planing chain is an endless chain having a transversely extending stringer for excavating the ballast and two obliquely upwardly extending elongated stringers guided in elongated troughs, a drive for moving the chain in an endless path, the endless ballast excavating and planing chain being arranged in front of the intermediate undercarriage, and further comprising a hydraulic drive linking the elongated guide troughs to the front machine frame part for vertically adjusting the transversely extending stringer of the chain with respect to the ballast bed.

3. The mobile machine of claim 2, wherein the elongated guide troughs have bent portions leading to the transversely extending stringer of the chain and extending substantially parallel to the ballast bed.

4. The mobile machine of claim 2, further comprising a vertically adjustable, transversely extending ballast planing and compacting device arranged adjacent the transversely extending stringer of the chain, the ballast planing and compacting device being substantially of the same length as the transversely extending stringer of the chain.

5. The mobile machine of claim 1, wherein the ballast redistributing device is mounted on the elongated, bridge-like machine frame, and has adjustable ballast discharge openings behind the rear undercarriage and arranged to discharge ballast at the respective ends of the new ties.

6. The mobile machine of claim 5, wherein the ballast conveyor means is comprised of an endless conveyor band extending from the intermediate to the rear undercarriage, the input end thereof being arranged immediately adjacent an upper end of the ballast excavating and planing chain for receiving the excavated ballast therefrom and the output end thereof being arranged above the ballast redistributing device for delivering the excavated ballast thereto.

7. The mobile machine of claim 6, wherein the ballast redistributing device is mounted on the rear machine frame part above the rear undercarriage, and further comprising an operator's cab mounted on the rear end of the rear machine frame part immediately behind the ballast redistributing device.

8. The mobile machine of claim 5, wherein the ballast redistributing device has additional ballast discharge openings behind the rear undercarriage and arranged to discharge ballast intermediate the respective new tie ends, the ballast redistributing device further comprising a ballast storage bin and the ballast discharge openings being in communication with the storage bin.

9. A mobile machine comprising an elongated, bridge-like machine frame mounted on a track consisting of two rails fastened to successive ties supported on a ballast bed for mobility in an operating direction for continuously renewing the track by replacing the rails and ties of the existing track by new rails and ties, the machine frame comprising (a) a front machine frame part having a front end and a rear end, ((b) a rear machine frame part having a front end and a rear end, the rear end of the front machine frame part and the front end of the rear machine frame part facing each other, (c) a front undercarriage supporting the front end of the front machine frame part on the track (d) a rear undercarriage supporting the rear end of the rear machine frame part on the track, (e) coupling means pivotally connecting the facing ends of the machine frame parts at lower ends thereof close to the ballast bed, (f) hydraulic pivoting and blocking drive means interconnecting the facing ends of the machine frame parts and effective to spread the facing machine frame part ends apart at upper ends thereof remote from the ballast bed in a horizontal direction whereby the lower ends of the facing machine frame part ends are pivoted about the coupling means and raised in a vertical direction, and the raised facing machine frame part ends are blocked in their raised position, (g) an intermediate undercarriage supporting the facing machine frame part ends on; the track and being raised off the track when the lower ends of the facing machine frame part ends are pivoted about the coupling means and raised in a vertical direction, (h) means mounted on the elongated, bridge-like machine frame between the front and rear undercarriages for (1) lifting the rails of the existing track off the ballast bed and spreading the lifted rails apart, (2) lifting the ties of the existing track off the ballast bed whereby residual mounds of ballast remain on the ballast bed between areas thereof where the lifted ties were embedded in the ballast bed, (3) planing the ballast bed from which the ties have been lifted by removing the residual mounds of ballast, the ballast bed planing means being constituted by a ballast excavating and planing chain arranged to excavate the residual ballast mounds and to smooth the ballast bed, (4) laying the new ties on the smooth ballast bed, and (5) spreading and laying the new rails on the new ties, (i) a ballast conveyor means mounted on the rear machine frame part, the ballast conveyor means having an input end facing the ballast excavating and planing chain for receiving the excavated ballast therefrom, (k) a work vehicle succeeding, and coupled to, the elongated, bridge-like machine frame, the work vehicle having a frame supported by a front undercarriage and a rear undercarriage on the track, (l) means mounted on the work vehicle for fastening the new rails to the new ties, (m) a ballast redistributing means mounted adjacent at least one of the undercarriages of the work vehicle, the ballast redistributing means having ballast discharge openings for redistributing ballast on the ballast bed, and (n) an additional ballast conveyor means mounted atop the work vehicle frame for conveying ballast to the ballast redistributing means.

10. The mobile machine of claim 9, wherein the ballast redistributing means comprises a ballast redistributing device adjacent the rear undercarriage of the work vehicle, and further comprising an additional endless ballast conveyor band having an input end above the ballast redistributing device, and an additional selectively operable ballast flow deflecting element between the additional ballast conveyor means and the input end of the additional endless ballast conveyor band for selectively directing the ballast to the redistributing device or to the additional endless ballast conveyor band.

11. The mobile machine of claim 10, wherein the additional endless conveyor band is pivotal laterally and displaceable longitudinally with respect to the track.

12. A mobile machine comprising an elongated, bridge-like machine frame mounted on a track consisting of two rails fastened to successive ties supported on a ballast bed for mobility in an operating direction for continuously renewing the track by replacing the rails and ties of the existing track by new rails and ties, the machine frame comprising (a) a front machine frame part having a front end and a rear end, (b) a rear machine frame part having a front end and a rear end, the rear end of the front machine frame part and the front end of the rear machine frame part facing each other, (c) a front undercarriage supporting the front end of the front machine frame part on the track (d) a rear undercarriage supporting the rear end of the rear machine frame part on the track, (e) coupling means pivotally connecting the facing ends of the machine frame parts at lower ends thereof close to the ballast bed, (f) hydraulic pivoting and blocking drive means interconnecting the facing ends of the machine frame parts and effective to spread the facing machine frame part ends apart at upper ends thereof remote from the ballast bed in a horizontal direction whereby the lower ends of the facing machine frame part ends are pivoted about the coupling means and raised in a vertical direction, and the raised facing machine frame part ends are blocked in their raised position, (g) an intermediate undercarriage supporting the facing machine frame part ends on the track and being raised off the track when the lower ends of the facing machine frame part ends are pivoted about the coupling means and raised in a vertical direction, (h) means mounted on the elongated, bridge-like machine frame between the front and rear undercarriages for (1) lifting the rails of the existing track off the ballast bed and spreading the lifted rails apart, (2) lifting the ties of the existing track off the ballast bed whereby residual mounds of ballast remain on the ballast bed between areas thereof where the lifted ties were embedded in the ballast bed, (3) planing the ballast bed from which the ties have been lifted by removing the residual mounds of ballast, the ballast bed planing means being constituted by a ballast excavating and planing chain arranged to excavate the residual ballast mound an to smooth the ballast bed, (4) laying the new ties on the smooth ballast bed, and (5) spreading and laying the new rails on the new ties, (i) a ballast conveyor means mounted on the rear machine frame part, the ballast conveyor means having an input end facing the ballast excavating and planing chain for receiving the excavated ballast therefrom, and (k) a transport vehicle preceding the elongated, bridge-like machine frame, the transport vehicle having a flat bed, the front end of the front machine frame part being pivotally supported on the flat bed of the transport vehicle and the front undercarriage supporting the front end being raised by the hydraulic pivoting and blocking drive means upon spreading the facing machine frame part ends apart in the horizontal direction.

13. The mobile machine of claim 12, further comprising a bridge connecting the flat bed of the transport vehicle with the front machine frame part, a mobile gantry crane for transporting the ties between the transport vehicle and the tie lifting and tie laying means, respectively, and a track supporting the gantry crane for movement therealong, a portion of the track being arranged on the bridge.

14. A mobile machine comprising an elongated, bridge-like machine frame mounted on a track consisting of two rails fastened to successive ties supported on a ballast bed for mobility in an operating direction for continuously renewing the track by replacing the rails and ties of the existing track by new rails and ties, the machine frame comprising (a) a front machine frame part having a front end and a rear end, (b) a rear machine frame part having a front end and a rear end, the rear end of the front machine frame part and the front end of the rear machine frame part facing each other, (c) a front undercarriage supporting the front end of the front machine frame part on the track, (d) a rear undercarriage supporting the rear end of the rear machine frame part on the track, (e) coupling means pivotally connecting the facing ends of the machine frame parts at lower ends thereof close to the ballast bed, (f) hydraulic pivoting and blocking drive means interconnecting the facing ends of the machine frame parts and effective to spread the facing machine frame part ends apart at upper ends thereof remote from the ballast bed in a horizontal direction whereby the lower ends of the facing machine frame part ends are pivoted about the coupling means and raised in a vertical direction, and the raised facing machine frame part ends are blocked in their raised position, (g) an intermediate undercarriage supporting the facing machine frame part ends on the track and being raised off the track when the lower ends of the facing machine frame part ends are pivoted about the coupling means and raised in a vertical direction, (h) means mounted on the elongated, bridge-like machine frame between the front and rear undercarriages for (1) lifting the rails of the existing track off the ballast bed and spreading the lifted rails apart, (2) lifting the ties of the existing track off the ballast bed whereby residual mounds of ballast remain on the ballast bed between areas thereof where the lifted ties were embedded in the ballast bed, (3) planing the ballast bed from which the ties have been lifted by removing the residual mounds of ballast, the ballast bed planing means being constituted by an endless ballast excavating and planing chain arranged in front of the intermediate undercarriage to excavate the residual ballast mounds and to smooth the ballast bed, the endless chain having a transversely extending stringer for excavating the ballast and two obliquely upwardly extending elongated stringers guided in elongated troughs, and a drive for moving the chain in an endless path, a hydraulic drive linking the elongated guide troughs to the front machine frame part for vertically adjusting the transversely extending stringer of the chain with respect to the ballast bed, and a vertically adjustable, transversely extending ballast planing and compacting device adjacent, and linked to, the transversely extending stringer of the chain, the ballast planing and compacting device being substantially of the same length as the transversely extending stringer of the chain, (4) laying the new ties on the smooth ballast bed, and (5) spreading and laying the new rails on the new ties, (i) a ballast conveyor means mounted on the rear machine frame part, the ballast conveyor means having an input end facing the ballast excavating and planing chain for receiving the excavated ballast therefrom, and an output end for discharging the excavated ballast, and (k) a ballast redistributing device arranged behind the rear undercarriage for receiving the excavated ballast discharged from the output end of the ballast conveyor means and for redistributing the excavated ballast on the smooth ballast bed on which the new ties and new rails have been laid.

15. A mobile machine comprising an elongated, bridge-like machine frame mounted on a track consisting of two rails fastened to successive ties supported on a ballast bed for mobility in an operating direction for continuously renewing the track by replacing the rails and ties of the existing track by new rails and ties, the machine frame comprising (a) a front machine frame part having a front end and a rear end, (b) a rear machine frame part having a front end and a rear end, the rear end of the front machine frame part and the front end of the rear machine frame part facing each other, (c) a front undercarriage supporting the front end of the front machine frame part on the track, (d) a rear undercarriage supporting the rear end of the rear machine frame part on the track, (e) coupling means pivotally connecting the facing ends of the machine frame parts at lower ends thereof close to the ballast bed, (f) hydraulic pivoting and blocking drive means interconnecting the facing ends of the machine frame parts and effective to spread the facing machine frame part ends apart at upper ends thereof remote from the ballast bed in a horizontal direction whereby the lower ends of the facing machine frame part ends are pivoted about the coupling means and raised in a vertical direction, and the raised facing machine frame part ends are blocked in their raised position, (g) an intermediate undercarriage supporting the facing machine frame part ends on the track and being raised off the track when the lower ends of the facing machine frame part ends are pivoted about the coupling means and raised in a vertical direction, (h) means mounted on the elongated, bridge-like machine frame between the front and rear undercarriages for (1) lifting the rails of the existing track off the ballast bed and spreading the lifted rails apart, (2) lifting the ties of the existing track off the ballast bed whereby residual mounds of ballast remain on the ballast bed between areas thereof where the lifted ties were embedded in the ballast bed, (3) planing the ballast bed from which the ties have been lifted by removing the residual mounds of ballast, the ballast bed planing means being constituted by a ballast excavating and planing chain arranged to excavate the residual ballast mounds and to smooth the ballast bed, (4) laying the new ties on the smooth ballast bed, and (5) spreading and laying the new rails on the new ties, (i) a ballast conveyor means mounted on the rear machine frame part, tee ballast conveyor means having an input end facing the ballast excavating and planing chain for receiving the excavated ballast therefrom, and an output end for discharging the excavated ballast, (k) a ballast redistributing device receiving the excavated ballast discharged from the output end of the ballast conveyor means and mounted on the rear machine frame part above the rear undercarriage, the ballast redistributing device having adjustable ballast discharge openings behind the rear undercarriage and arranged to redistribute the excavated ballast on the smooth ballast bed on which the new ties and new rails have been laid and at the respective ends of the new ties, (1) the ballast conveyor means being comprised of an endless conveyor band extending from the intermediate to the rear undercarriage, the input end thereof being arranged immediately adjacent an upper end of the ballast excavating and planing chain for receiving the excavated ballast therefrom and the output end thereof being arranged above the ballast redistributing device for delivering the excavated ballast thereto, (l) an operator's cab mounted on the rear end of the rear machine frame part immediately behind the ballast redistributing device, and (m) an additional endless ballast conveyor band having an input end above the ballast redistributing device and projecting rearwardly beyond the operator's cab, and a selectively operable ballast flow deflecting element between the output end of the ballast conveyor means and the input end of the additional endless ballast conveyor band for selectively directing the ballast to the redistributing device or to the additional endless ballast conveyor band.

16. The mobile machine of claim 15, wherein the additional endless conveyor band is pivotal laterally and displaceable longitudinally with respect to the track.

* * * * *